United States Patent [19]

Lang et al.

[11] 4,239,123

[45] Dec. 16, 1980

[54] RELEASABLY FIXED MOUTHPIECE AS DEVICE FOR DRINKING FROM A CONTAINER

[76] Inventors: Ludwig Lang; Ortulf G. Lang, both of Zimmerstrasse 10-12, 61 Darmstadt, Fed. Rep. of Germany

[21] Appl. No.: 30,456

[22] Filed: Apr. 16, 1979

[30] Foreign Application Priority Data

Apr. 20, 1978 [DE] Fed. Rep. of Germany ..... 2817199

[51] Int. Cl.[3] ..... A47G 21/18

[52] U.S. Cl. ..... 220/90.6; 239/33

[58] Field of Search ..... 239/33; 229/7 R, 7 S; 215/1 A, 229; 220/85 SP, 90.2, 90.4, 90.6; 222/478, 567, 569, 570; D7/42

[56] References Cited

U.S. PATENT DOCUMENTS

| | | | |
|---|---|---|---|
| 2,171,094 | 8/1939 | Livoti | 220/85 SP |
| 2,435,033 | 1/1948 | Campbell | 239/33 X |
| 3,863,820 | 2/1975 | Wharton | 222/569 |
| 4,066,191 | 1/1978 | Coleman | 220/90.2 X |

FOREIGN PATENT DOCUMENTS

| | | | |
|---|---|---|---|
| 525487 | 5/1956 | Canada | 222/478 |
| 1906686 | 9/1970 | Fed. Rep. of Germany . | |
| 214856 | 5/1924 | United Kingdom . | |

*Primary Examiner*—Andres Kashnikow

*Attorney, Agent, or Firm*—Blanchard, Flynn, Thiel, Boutell & Tanis

[57] ABSTRACT

A mouthpiece for use on a container having a tear-open closure slot therein. The mouthpiece has a conically-shaped mounting portion at one end and a tapered projection at the other end and about which the mouth of the user can be placed. An opening extends axially through the mouthpiece and an air supply opening is provided through the mounting portion. The mounting portion is adapted to be snugly inserted into the opening in the container to form a liquid tight seal thereat. The mouthpiece is to be kept in a sealed package. As a result, the bacteria in and around the opening to the container will be prevented from coming into contact with the user when the user uses the aforesaid mouthpiece in association with the container.

1 Claim, 4 Drawing Figures

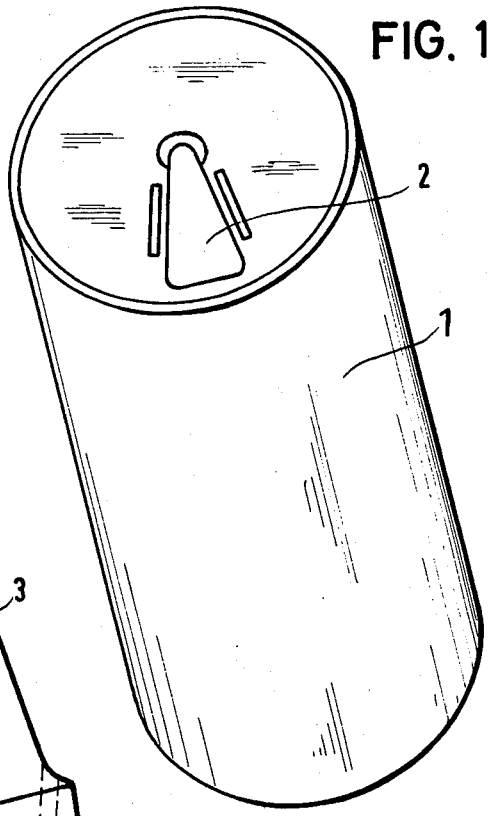
FIG. 1
FIG. 2
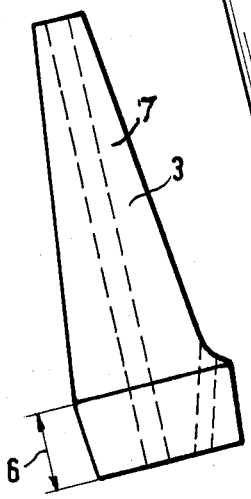
FIG. 3
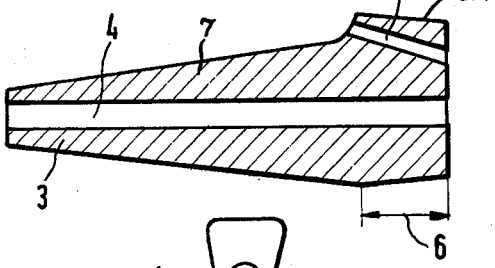
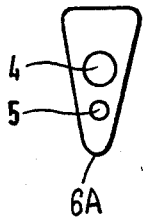
FIG. 4

RELEASABLY FIXED MOUTHPIECE AS DEVICE FOR DRINKING FROM A CONTAINER

FIELD OF THE INVENTION

The invention relates to a mouthpiece which can be releasably fixed to a container which is filled with drinkable liquid, preferably from a can having a tear-open closure slot.

BACKGROUND OF THE INVENTION

The method of drinking from a filled container after opening by means of a tear-open closure slot is lately encountering objections for hygienic reasons. It has been found that in the area of the slot opening, bacterial contamination can form on the container. This unhygienic method of drinking needs an improvement which conforms to the purpose of use, which improvement is the subject matter of the invention.

A mouthpiece is provided, which is mounted due to its shape snugly and releasably fixed in the opening in the lid of the container. This mouthpiece, which is preferably manufactured as a throw-away part and in addition is packed in a plastic sleeve or package, which is opened only prior to use, is discussed more in detail with reference to one exemplary embodiment.

BRIEF DESCRIPTION OF THE DRAWING

In the drawing:

FIG. 1 is a perspective view of a container with an opened slot in the container lid;

FIG. 2 is a side view of a mouthpiece;

FIG. 3 is a longitudinal cross-sectional view of the mouthpiece with openings; and FIG. 4 is an end view of the insert part of the mouthpiece.

DETAILED DESCRIPTION

Most common for the subject matter of the invention is a can 1 having a stamped-in tear-open closure for the opening 2. The shape of the slot on the lid of the can 1 can be a manufacturing standard for the manufacturing process, such as triangularly shaped as shown according to which the shape of a mouthpiece 3 is adjusted.

As can be seen from FIGS. 2 to 4, the mouthpiece 3 has a triangularly shaped mounting portion 6 having a conicity, which is especially preferable for manufacturing reasons and for reasons of facilitating a snug and liquid sealing fit in the slot 2 of the container 1. That is, the inclined wall of the slot 2 in the can 1 will snugly and tightly sealingly engage said mounting portion 6. The conicity converges toward one end of the mounting portion 6. The mouthpiece 3 has a generally tapered projection 7 on the end of the mounting portion 6 remote from the aforesaid end to which the conical wall thereof converges. The tapered projection 7 has a main opening 4 extending axially therethrough to permit the flow of drinking liquid therethrough. A laterally extending, short opening 5 is arranged in the mounting portion 6 adjacent the apex 6A of the triangle, which opening is used for balancing the pressure inside the container and permits an unrestricted drinking of the liquid in the container. The mounting portion 6 is kept short with respect to the entire length of the mouthpiece 3, so that the opening 5 is not covered up during drinking. To maintain or keep the mouthpiece clean, it can be stored in a not illustrated protective sleeve until its use.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a mouthpiece which can be releasably fixed to a container which is filled with a drinkable liquid, said container having a tear-open closure slot to thereby prevent contact by the user's mouth with said container, the improvement comprising wherein said mouthpiece has a mounting portion thereon at one end conforming to the shape of said slot in said container and a mouthpiece end at the other end, said mounting portion having an inclined external wall surface converging toward the central axis of said mouthpiece and in a direction toward said one end of said mouthpiece, the peripheral dimension of said mounting portion at the end of said inclined wall surface being less than the peripheral dimension of said slot in said container, said peripheral dimension of said mounting portion at the end adjacent said mouthpiece end being greater than said peripheral dimension of said slot in said container, said mounting portion being received in said slot and in sealing engagement with the inwardly facing peripheral wall surface of said slot, wherein said mouthpiece has a main opening extending the entire length and through the central portion of said mouthpiece, wherein a laterally extending, short opening, separate from said main opening, is provided through said mounting portion, the ends of said short opening exiting from said mounting portion at said one end and at the juncture between said mouthpiece end and said mounting portion, wherein said slot is generally triangular in shape having a base and an apex, wherein said mounting portion is triangularly shaped also having a base and an apex alignable with said base and said apex in said slot, said short opening extending through said mounting portion adjacent said apex on said mounting portion.

* * * * *